US008573931B2

(12) United States Patent
Blass et al.

(10) Patent No.: US 8,573,931 B2
(45) Date of Patent: Nov. 5, 2013

(54) COOLING APPARATUS FOR A MOTOR VEHICLE

(75) Inventors: Uwe Blass, Moeglingen (DE); David Haar, Stuttgart (DE); Ulrich Vollert, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 910 days.

(21) Appl. No.: 12/721,187

(22) Filed: Mar. 10, 2010

(65) Prior Publication Data

US 2010/0229810 A1 Sep. 16, 2010

(30) Foreign Application Priority Data

Mar. 10, 2009 (DE) ..... 10 2009 012 025

(51) Int. Cl.
*F04D 29/52* (2006.01)

(52) U.S. Cl.
USPC ..... 415/176; 415/213.1; 415/214.1; 415/220

(58) Field of Classification Search
USPC ..... 415/176, 220, 214.1, 213.1; 416/169 A, 416/189
See application file for complete search history.

(56) References Cited

U.S. PATENT DOCUMENTS

| | | | | |
|---|---|---|---|---|
| 3,842,902 | A * | 10/1974 | Poslusny | 165/51 |
| 4,213,426 | A * | 7/1980 | Longhouse | 123/41.49 |
| 5,143,516 | A | 9/1992 | Christensen | |
| 5,701,854 | A * | 12/1997 | Hauser | 123/41.49 |
| 5,791,876 | A * | 8/1998 | Moser | 416/170 R |
| 2005/0029027 | A1 | 2/2005 | Kunikata et al. | |
| 2006/0042569 | A1 | 3/2006 | Jacquay | |
| 2006/0054304 | A1 | 3/2006 | Tonhaeuser et al. | |
| 2007/0209613 | A1 | 9/2007 | Pantow | |
| 2007/0277752 | A1 | 12/2007 | Smith et al. | |
| 2008/0035316 | A1 | 2/2008 | Blass et al. | |
| 2010/0014967 | A1 | 1/2010 | Blass et al. | |

FOREIGN PATENT DOCUMENTS

| | | | |
|---|---|---|---|
| DE | 33 04 297 | A1 | 3/1984 |
| DE | 90 16 496.2 | | 4/1991 |
| DE | 103 16 108 | A1 | 4/2004 |
| DE | 10 2007 031 462 | A1 | 1/2008 |
| DE | 10 2006 037 628 | A1 | 2/2008 |
| DE | 10 2006 037 641 | A1 | 2/2008 |
| DE | 10 2006 047 236 | A1 | 4/2008 |
| EP | 0 746 689 | B1 | 4/2002 |
| EP | 1 890 019 | A1 | 2/2008 |
| EP | 2 020 489 | A1 | 2/2009 |
| WO | WO 98/37319 | | 8/1998 |

* cited by examiner

*Primary Examiner* — Ninh H Nguyen
(74) *Attorney, Agent, or Firm* — Muncy, Geissler, Olds & Lowe, PLLC

(57) ABSTRACT

A cooling apparatus for a motor vehicle with an internal combustion engine is provided that includes at least one heat exchanger through which air can pass, at least one axial fan that is located behind the at least one heat exchanger in a direction of air flow and has a circumferential ring with which ring is associated a stationary baffle ring, and a fan shroud adjoining the at least one heat exchanger. At least one motion compensating element with a sealing function is provided between the baffle ring and the at least one fan shroud.

17 Claims, 6 Drawing Sheets

COOLING APPARATUS FOR A MOTOR VEHICLE

This nonprovisional application claims priority under 35 U.S.C. §119(a) to German Patent Application No. DE 10 2009 012 025.4, which was filed in Germany on Mar. 10, 2009, and which is herein incorporated by reference.

BACKGROUND OF THE INVENTION

1. Field of the Invention

The invention concerns a cooling apparatus for a motor vehicle with an internal combustion engine.

2. Description of the Background Art

Cooling apparatuses for motor vehicles are primarily used for cooling an internal combustion engine, but optionally also for cooling a refrigerant circuit for an air conditioner. Consequently, the cooling apparatus generally includes multiple heat exchangers, such as a radiator, an intake air cooler, an oil cooler, and a condenser for cooling the air conditioner's refrigerant. Also associated with the cooling apparatus is a fan, such as an axial fan with a fan shroud. In relatively large motor vehicles, the fan is driven directly by the internal combustion engine through the crankshaft or a belt drive, and hence is mounted in a fixed position relative to the engine. In contrast, the heat exchangers, in particular the radiator, are mounted in a fixed position relative to the vehicle, as is the fan shroud attached to the heat exchanger or heat exchangers. The resulting relative motions between the radiator or fan shroud on the one side and the fan on the other side are compensated by a motion compensating element, also called a compensating element, with the compensating element simultaneously performing a sealing function.

A cooling apparatus of this nature has been disclosed in the applicant's DE 33 04 297 C2, which is incorporated herein by reference. The fan, implemented as an axial fan, has a circumferential ring or baffle ring, which is rigidly attached to the blade tips and rotates with the fan. The upstream, overhanging end of the circumferential ring projects into an intake nozzle which, like the fan, is mounted in a fixed position relative to the engine. Located between a fan shroud, which is attached to a radiator mounted in a fixed position relative to the engine, and the intake nozzle is a motion compensating element in the form of an elastic lip, by means of which relative motions are compensated.

Disclosed in the applicant's DE 10 2007 031 462 A1, which is incorporated herein by reference, is another cooling apparatus for a motor vehicle, wherein a motion compensating element is located between a radiator and a fan shroud, by which means the fan shroud has a flow-optimized contour, which is to say without breaks or sharp bends.

Disclosed in the applicant's DE 10 2006 047 236 A1, which corresponds to U.S. Publication No. 2010/0014967, which is incorporated herein by reference, is an axial fan with a recessed circumferential ring and upstream baffle ring, which in addition to aerodynamic advantages has the advantage of a small axial installation depth, which is especially important in modern vehicles on account of the limited installation space.

Disclosed in EP 0 746 689 B1 is an axial fan driven by an electric motor, known as an electric fan, wherein the axial fan has a circumferential ring attached to the blade tips, and rotates inside a fan frame or a frame ring. Together with the stationary frame ring, the rotating fan ring forms an annular gap, through which passes recirculating air—in the opposite direction to the primary flow in the fan. Located on the frame ring in the vicinity of the annular gap are vanes extending axially and projecting approximately radially inward, which are intended to counteract a twisting of the recirculation flow.

SUMMARY OF THE INVENTION

It is therefore an object of the invention to provide a cooling apparatus such that a flow-optimized connection of a baffle ring to a fan shroud is produced and a maximally compact axial construction and high air flow rate are achieved.

According to an embodiment of the invention, there is provided, between the baffle ring and the fan shroud, at least one motion compensating element, which mutually seals the parts that move relative to one another, namely on the one side the baffle ring mounted in a fixed position relative to the engine and on the other side the fan shroud mounted in a fixed position relative to the vehicle, so that substantially all of the air passing through the heat exchanger is delivered to the fan. In this way, leakage losses resulting from the relative motions are avoided. Because of the location of the compensating element at the downstream end of the fan shroud, the latter can be designed with desirable flow characteristics, which is to say without breaks—which reduces the pressure drop of the air flow in the fan shroud, and increases the fan output. Moreover, the advantages associated with the prior art fan (circumferential ring and upstream baffle ring), in particular its shortened axial installation space, are retained.

According to an embodiment, the compensating element can be attached either at the baffle ring or at the fan shroud, it then rests in a sealing manner against either the fan shroud or the baffle ring. Thus, in one case an attachment function should be provided at the baffle ring and a sealing function at the fan shroud, while in the other case an attachment function should be provided at the fan shroud and a sealing function at the baffle ring. Both versions have their advantages.

According to an embodiment, the fan shroud can have, on its rear wall, an annular sealing surface, which the compensating element rests against and performs a sealing function. The sealing surface can be designed as a flat surface, which likewise results in a short axial construction.

In another embodiment, the compensating element can have an annular sealing lip, which rests against the annular sealing surface with an internal elastic stress. The latter results from the fact that the sealing lip is elastically deformed during installation.

In another embodiment, the baffle ring can be designed to be approximately C-shaped in cross-section, with the radially inward leg of the C forming the baffle ring, and the radially more outward leg forming an attachment section. The compensating element may be attached to the attachment section in a variety of ways, for example by clamping, by a snap-on connection, or by a tension band.

In another embodiment, provision is made for the baffle ring, including its attachment section, to be arranged essentially flush with the air intake plane of the fan. This achieves the advantage of a short axial construction, with the compensating element adjoining the baffle ring directly and without significant increase in the axial installation depth. In this way, a low-loss transition from the fan shroud to the baffle ring or to the fan is created that has desirable flow characteristics.

According to an embodiment, the baffle ring can be designed as an intake nozzle into which projects the forward region of the circumferential ring that is recessed in the direction of flow. In this way, a further stabilization of the air flow in the blade tip region is achieved.

According to another embodiment, the baffle ring can be supported relative to the engine block of the internal combustion engine by struts, which preferably engage the attachment section of the baffle ring. The fixed mounting of the baffle ring and fan relative to the engine makes it possible to achieve a minimal gap and thus increased fan output.

In another embodiment, an outlet guide vane can be downstream of the axial fan and can be integrated in the struts for holding the baffle ring. An outlet guide vane of this type is described in detail in DE 10 2006 037 628 A1, which is incorporated herein by reference, of the applicant. The outlet guide vane makes it possible to improve the efficiency of the fan and decrease the losses in the lateral outflow of the fan air flow.

According to another embodiment, the baffle ring can have, in a region of a 180° deflecting gap, vanes that extend axially and project radially inward, which effect an axial orientation of the twisting recirculation flow. This achieves the advantage that the recirculation flow entering the primary flow of the fan is largely free of twist. This reduces flow losses and noise.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
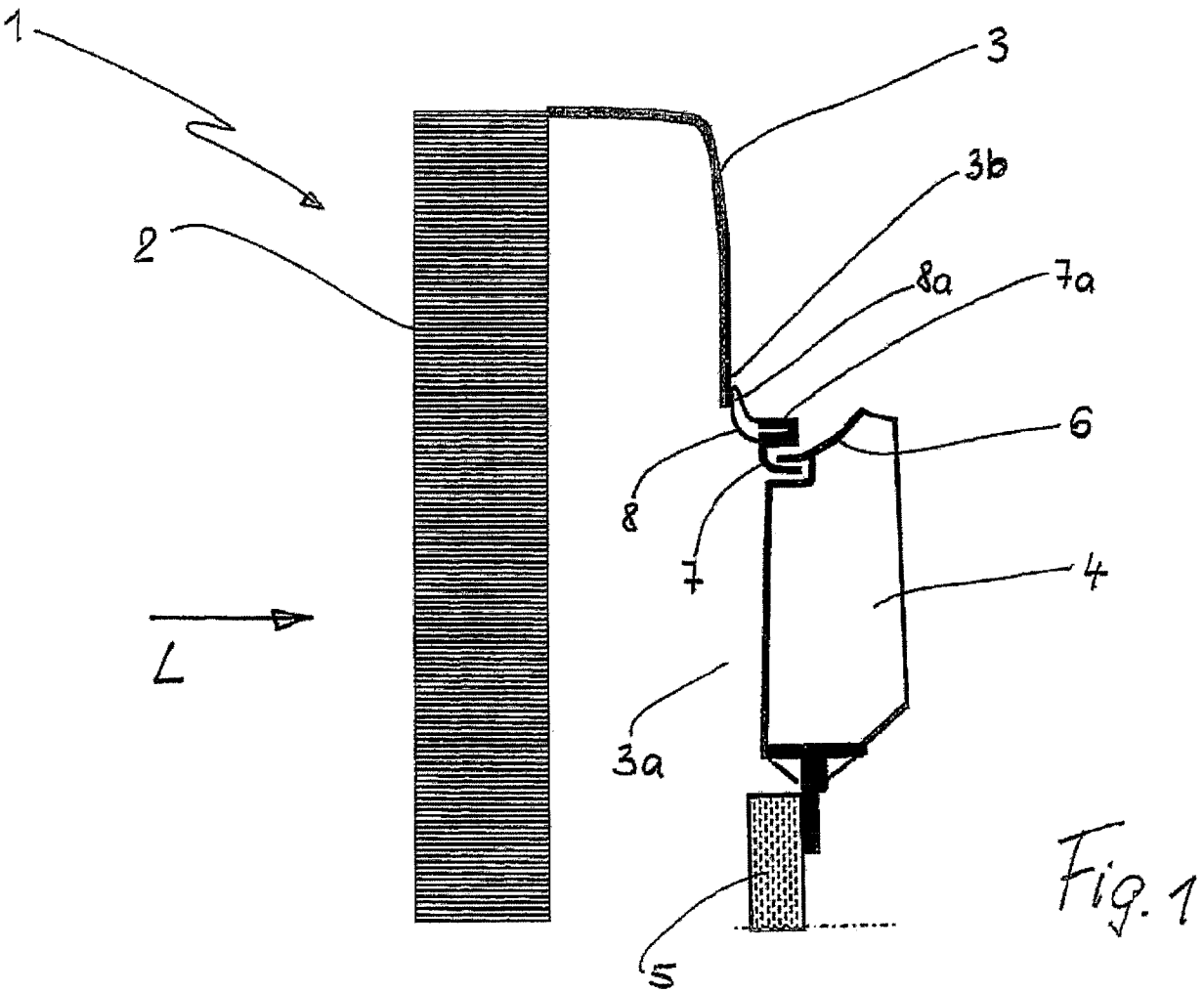
FIG. 1 illustrates a cooling apparatus in a half section view, comprising a radiator, a fan shroud, and a fan.

FIG. 1 shows a half section view of a cooling apparatus 1, which includes a radiator 2, a fan shroud 3, and a fan 4 that is driven by an internal combustion engine (not shown) of a motor vehicle through a hydraulic friction clutch 5, preferably via the crankshaft. Consequently, the fan 4 is mounted in a fixed position relative to the engine, which is to say that it executes the same motions as the engine. In contrast, the radiator 2 is supported on a vehicle frame that is not shown (mounted in a fixed position relative to the vehicle)—this also applies to the fan shroud 3, which is rigidly attached to the radiator 2. As a result, relative motions occur between the fan shroud 3 and the baffle ring 7. The radiator 2 can be augmented by additional heat exchangers that are not shown, for example intake air coolers, oil coolers, or a condenser for a vehicle air conditioner, to form a cooling module. The direction of air flow is indicated by an arrow L, which is to say that the fan 4 is configured to draw air. The basic design of the fan 4 corresponds to the construction that is described and illustrated in the aforementioned DE 10 2006 047 236 A1 of the applicant. According thereto, the fan 4 is designed as an axial fan and has a circumferential ring 6, with which is associated a baffle ring 7. With respect to further details of the fan 4 with circumferential ring 6 and baffle ring 7, reference is made to the aforementioned document of the applicant, the full content of which is incorporated in the disclosure content of the present application.

Between the baffle ring 7 and the fan shroud 3 is located, according to the invention, a motion compensating element 8, hereinafter also called a compensating element for short, which compensates the relative motions between the fan shroud 3 and baffle ring 7 while simultaneously performing a sealing function. The baffle ring 7, which is attached to the internal combustion engine (arranged in a fixed position relative to the engine) in a manner not shown here is approximately C-shaped in cross-section and has an attachment section 7*a* located radially outside the circumferential ring 6; one end of the compensating element 8 is clamped, and thus held, in this attachment section. The other end of the compensating element 8 is designed as a sealing lip 8*a*, which rests against the fan shroud 3. The latter has an air passage 3*a*, which is enclosed by a circular sealing surface 3*b*, against which the sealing lip 8*a* rests and thus can slide in the radial direction when relative motions occur. Equally possible are relative motions in the axial direction, without causing the sealing lip 8*a* to lift away from the sealing surface 3*b* with which it makes elastic contact. This arrangement of the compensating element 8 results in a flow-optimized transition from the interior of the fan shroud 3 to the baffle ring 7, and thus to the fan 4. Moreover, an axially compact construction is achieved.

Figures 2, 3, 4, 5:
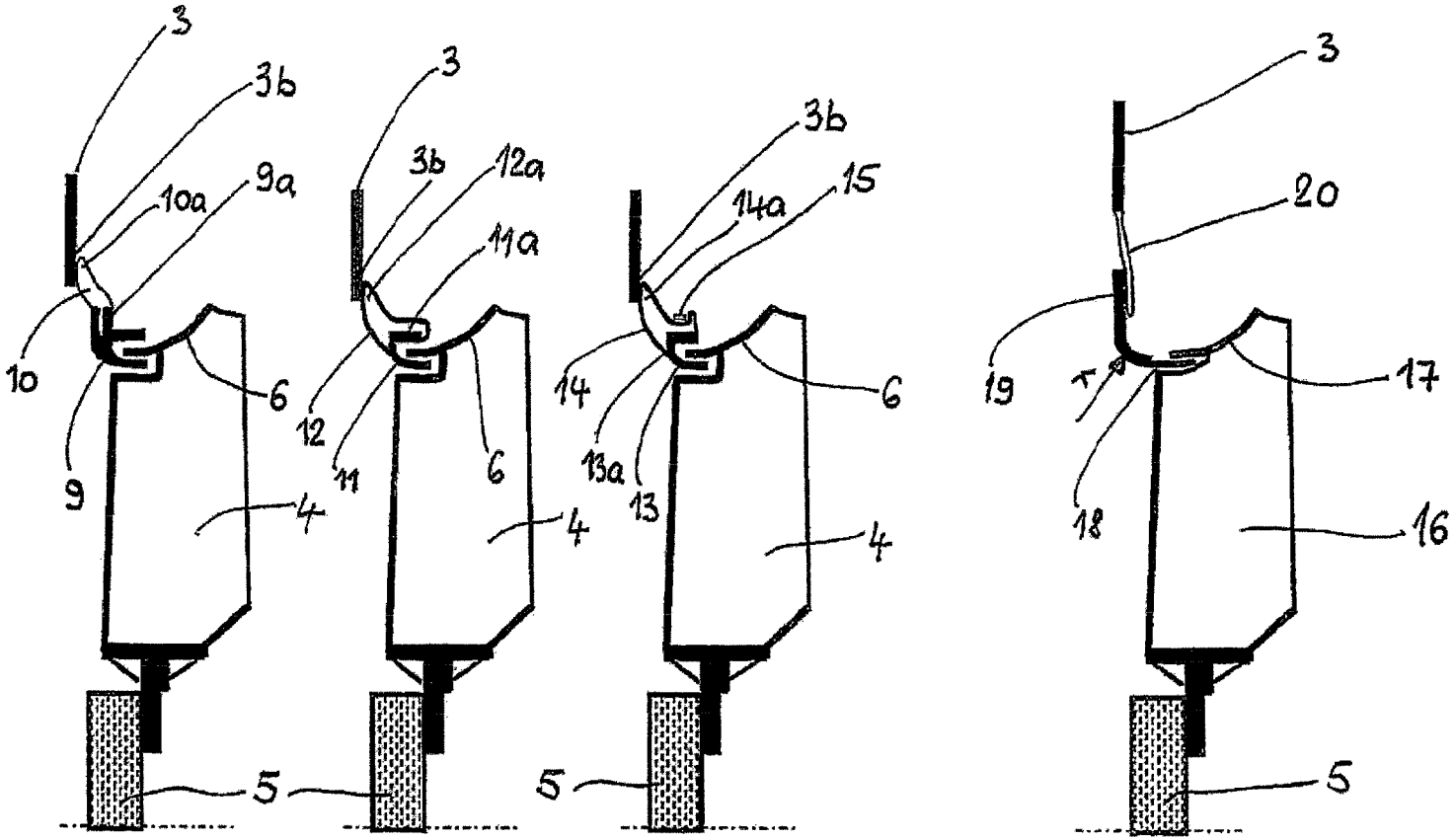
FIG. 2 illustrates the fan from FIG. 1 with a modified compensating element.
FIG. 3 illustrates another embodiment of the compensating element.
FIG. 4 illustrates another embodiment of the compensating element.
FIG. 5 illustrates a modified version of the compensating element.

FIG. 2 shows a modified version of the compensating element and of the baffle ring, with identical parts being labeled with the same reference numbers as in FIG. 1. The fan shroud 3 is only partially shown here, which is to say essentially only its sealing surface 3*b* is shown. A baffle ring 9 is likewise C-shaped in cross-section, but has an attachment section 9*a* that extends essentially radially, in which is clamped a compensating element 10. The latter has an elastically deformable sealing lip 10*a* that makes sealing contact with the sealing surface 3*b* of the fan shroud 3, even when relative motions occur.

FIG. 3 shows another embodiment of a baffle ring 11 with compensating element 12. The baffle ring 11 is once again C-shaped in cross-section, and has an external cylindrical attachment section 11*a*, which is enclosed by the compensating element 12 in the manner of a snap-on connection. The compensating element 12, which is made of an elastic material such as rubber, can thus be clipped onto the attachment section 11*a* and its sealing lip 12*a* is then in contact with the sealing surface 3*b*.

FIG. 4 shows another embodiment of a baffle ring 13 and a compensating element 14. The baffle ring 13 has a cylindrical attachment section 13*a*, onto which the compensating element 14 is pushed and then attached by a tension band 15 to the baffle ring 13. The compensating element 14 has a sealing lip 14*a*, which is in contact with the flat sealing surface 3*b*.

Each of the embodiments of the baffle rings 7, 9, 11, 13 described above are characterized by a C-shaped cross-section into which projects the upstream part of the circumferential ring 6, so that the effect of an intake nozzle as known from the above-mentioned prior art is produced. A secondary air stream is drawn in from outside, deflected by 180°, and supplied to the blade tip region. This results in further stabilization of the fan flow. The effect of the intake nozzle can be amplified by an appropriate design and aerodynamic refinement.

FIG. 5 shows a modified version of the invention for a fan 16 with a circumferential ring 17, with which a baffle ring 18 is associated. Adjoining the essentially cylindrical baffle ring 18 through a radius r is a circular sealing flange 19. Attached to the inside region of the fan shroud 3 is an elastic, circular compensating element 20, which contacts the outside of the sealing flange 19. The compensating element 20 permits relative motions in the radial and axial directions, and is characterized by an especially compact construction in the axial direction.

Figure 6:
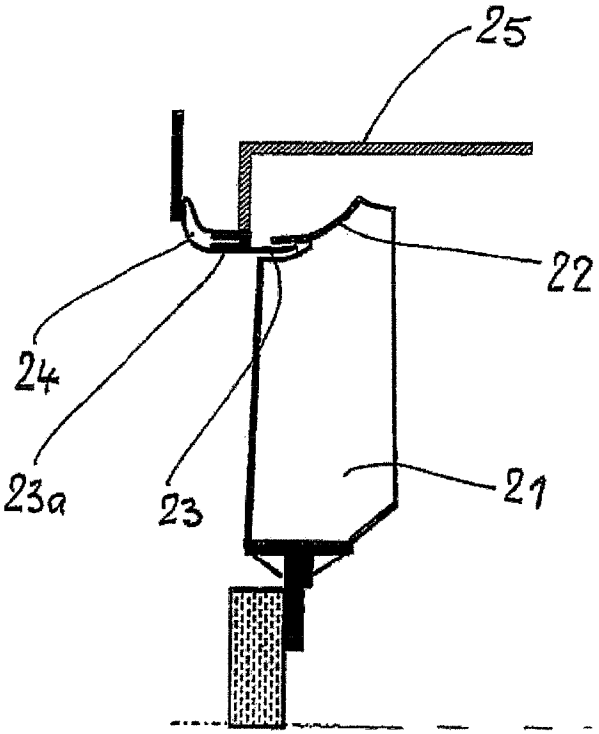
FIG. 6 illustrates a first form of attachment of the baffle ring.

FIG. 6 shows another embodiment of the invention with a fan 21, a circumferential ring 22, and a baffle ring 23, which overlaps the circumferential ring 22 in the axial direction. In axial extension opposite the direction of air flow, the baffle ring 23 is adjoined by an attachment section 23*a*, to which are attached a compensating element 24 on the one side and a strut 25 on the other side. By means of the strut 25—as well as additional struts distributed over the circumference but not shown—the baffle ring 23 can be attached relative to the engine block that is not shown, so that the fan 21 and baffle ring 23 are both located in a fixed position relative to the engine. In this way, a minimal gap between the baffle ring 23 and circumferential ring 22 can be achieved. This applies in equal measure to the preceding exemplary embodiments.

Figure 7:
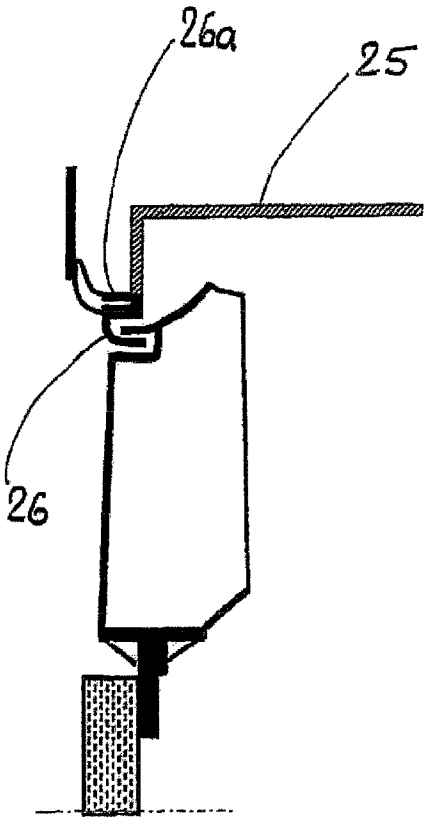
FIG. 7 illustrates a second form of attachment of the baffle ring.

FIG. 7 shows another possibility for attachment of the struts 25 to a baffle ring 26, which corresponds to the embodiment from FIG. 1. The baffle ring 26 is C-shaped in cross-section and optionally designed as an intake nozzle, and has an attachment section 26*a*, which the struts 25 grip. In this way a shortened axial construction is achieved, especially in comparison to FIG. 6.

Figure 8B:
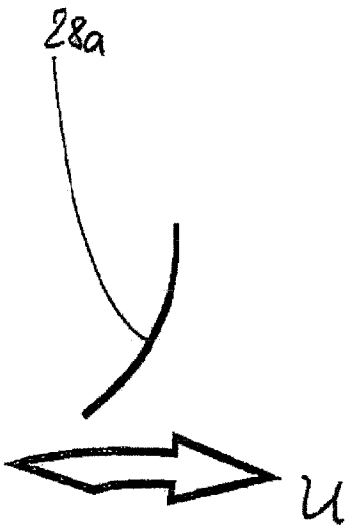
FIG. 8*b* illustrates a partial section in the plane VIIIb-VIIIb.
Figure 8A:
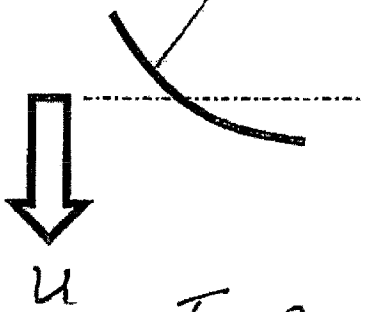
FIG. 8*a* illustrates a partial section in the plane VIIIa-VIIIa.
Figure 8:
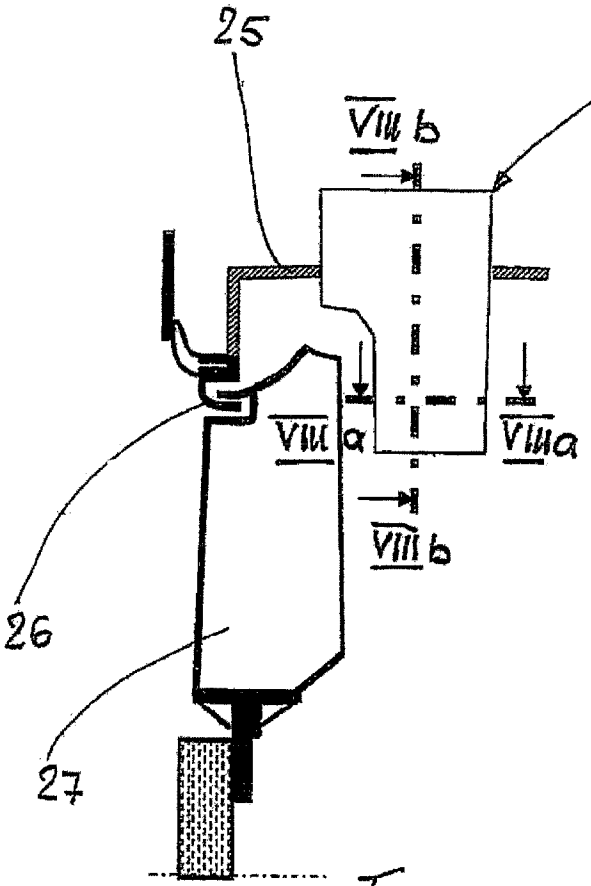
FIG. 8 illustrates a fan with downstream outlet guide vane.

FIG. 8 shows a development of the invention with a fan 27, the C-shaped baffle ring 26, and strut 25, which correspond to the exemplary embodiment from FIG. 7. Behind the fan 27 in the direction of air flow is located, in the radially outward region, an outlet guide vane 28, which is attached to the struts 25 or integrated therewith. An outlet guide vane 28 of this nature is described and shown in detail in DE 10 2006 037 628 A1 of the applicant; this is comprised of flow control elements located behind the axial fan in the direction of air flow and extending essentially in the radial direction, which influence the emerging fan air flow.

FIG. 8*a* shows a section in the plane VIIIa-VIIIa through a flow control element 28*a* of the outlet guide vane 28. The direction of rotation of the fan 27 is indicated by an arrow U.

FIG. 8*b* shows a section through the flow control element 28*a* in the plane VIIIb-VIIIb. The direction of rotation of the fan is indicated by an arrow U. The design and arrangement of the flow control elements 28*a* of the outlet guide vane 28 produce a delay in the fan discharge flow in combination with a pressure recovery.

Figures 9, 10, 12, 13:
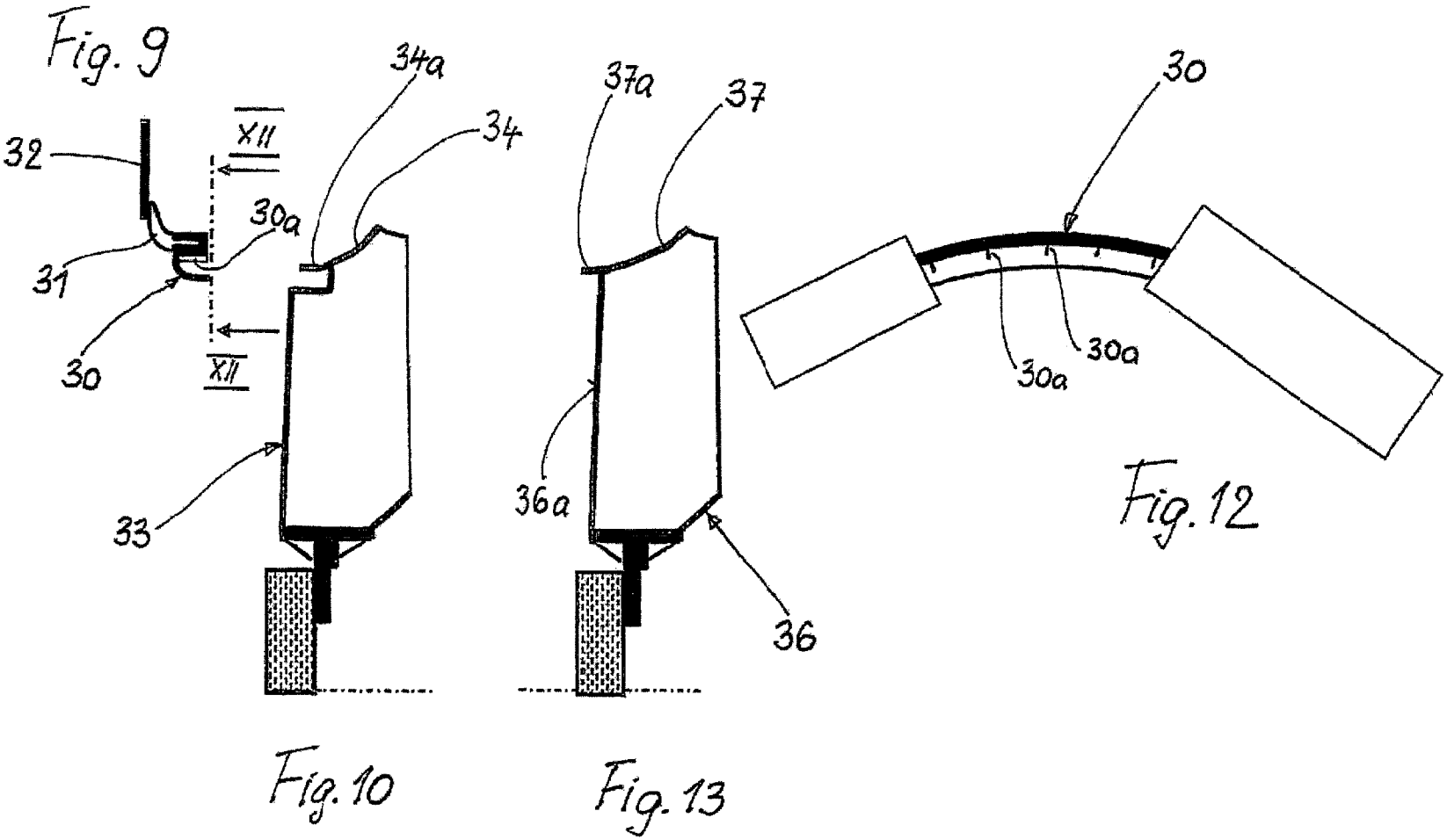
FIG. 9 illustrates a modified baffle ring without fan.
FIG. 10 illustrates a fan without baffle ring.
FIG. 12 illustrates a partial view in the axial direction of the baffle ring from FIG. 9.
FIG. 13 illustrates another embodiment of a fan with forward-projecting circumferential ring.

FIG. 9 shows another embodiment of a baffle ring 30, on which is arranged a motion compensating element 31 for sealing with respect to a fan shroud 32 that is partially shown. On its inside, the baffle ring 30 has vanes that extend axially and project radially inward in the form of ribs 30*a*.

FIG. 10 shows an axial fan 33 with a circumferential ring 34, which has a free, inflow-side ring end 34*a*.

Figure 11:
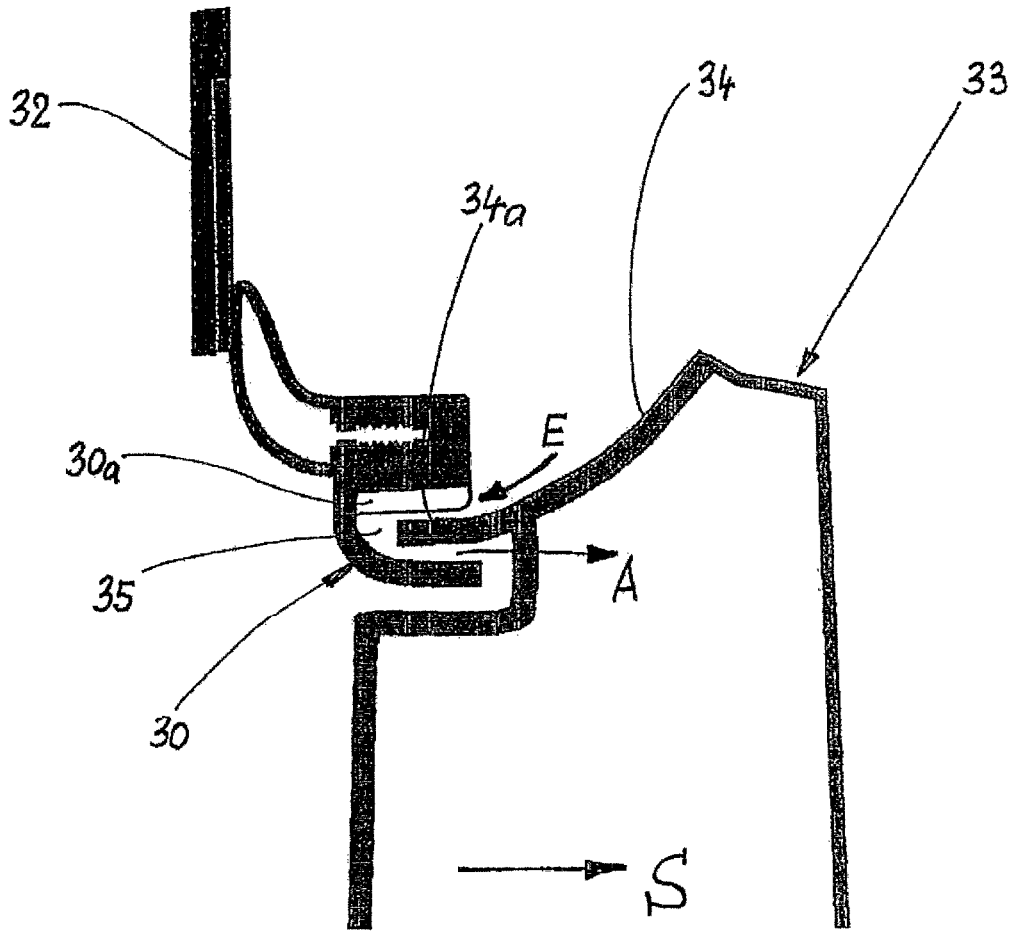
FIG. 11 illustrates an enlarged view of the baffle ring and fan from FIG. 9 and FIG. 10.

FIG. 11 shows the construction and interaction of the baffle ring 30 from FIG. 9 and the fan 33 from FIG. 10 in an enlarged view. Together with the ring end 34*a* of the circumferential ring 34, the approximately C-shaped baffle ring 30 forms a circumferential gap 35 with a 180° deflection. The flow entering the circumferential gap 35, a recirculation flow, is labeled by an arrow E, and the air flow exiting the circumferential gap 35 is labeled by an arrow A. The primary flow through the fan 33 is labeled by an arrow S. The recirculation flow is thus deflected by 180° in the circumferential gap 35. The entering recirculation flow as indicated by arrow E encounters the vanes 30*a* that extend approximately in the axial direction and project approximately radially from the baffle ring 30 and that orient the twisting flow in the axial direction, which is to say eliminate, or at least substantially reduce, the circumferential component of the recirculation flow. This achieves the result that the recirculation flow shown by arrow A emerging from the circumferential gap 35 enters the primary flow S largely free of twist, thus avoiding flow losses in this region. This improves the efficiency of the fan.

FIG. 12 shows a view in the axial direction indicated by the arrows XII-XII in FIG. 9. Visible here are the vanes 30*a* projecting radially inward from the outer part of the baffle ring 30*a*; these vanes orient the recirculation flow axially.

FIG. 13 shows a modified fan 36 with a circumferential ring 37, which has a free, inflow-side ring end 37*a* that projects above the inflow edge 36*a* of the fan blades. This fan 36 may also be combined with the baffle ring 30 and the vanes 30*a*. In this case, a smaller circumferential gap results than in the exemplary embodiment from FIG. 10 or FIG. 11. For this reason, the fan 33 in combination with the baffle ring 30 with approximately flush termination has a shallower axial depth and is spatially optimized in this regard.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the motion compensating element is attached to the baffle ring and rests freely against the fan shroud.

2. The cooling apparatus according to claim 1, wherein the motion compensating element makes sealing contact with the fan shroud.

3. The cooling apparatus according to claim 1, wherein the fan shroud has a rear wall with an annular sealing surface.

4. The cooling apparatus according to claim 3, wherein the motion compensating element has an annular sealing lip that contacts the annular sealing surface.

5. The cooling apparatus according to claim 1, wherein the stationary baffle ring is approximately C-shaped in cross-section and has an attachment section.

6. The cooling apparatus according to claim 1, wherein the motion compensating element is configured as an annular, elastic sealing element.

7. The cooling apparatus according to claim 1, wherein the motion compensating element is fixedly attached to the baffle ring and rests slidably against the fan shroud.

8. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the stationary baffle ring is approximately C-shaped in cross-section and has an attachment section, and wherein the attachment section is configured as a clamping section.

9. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the stationary baffle ring is approximately C-shaped in cross-section and has an attachment section, and wherein the motion compensating element forms a snap-on connection with the attachment section.

10. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the stationary baffle ring is approximately C-shaped in cross-section and has an attachment section, and wherein the motion compensating element is held on the attachment section by a tensioning device or a tension band.

11. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the stationary baffle ring terminates substantially flush with the air intake plane of the fan.

12. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the stationary baffle ring is approximately C-shaped in cross-section and has an attachment section, and wherein the baffle ring is configured as an intake nozzle into which a forward section of the circumferential ring projects.

13. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the baffle ring is supported on a block of the internal combustion engine via struts.

14. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein an outlet guide vane is provided downstream of the axial fan.

15. The cooling apparatus according to claim 14, wherein the outlet guide vane is integrated in the struts.

16. A cooling apparatus for a motor vehicle having an internal combustion engine, the cooling apparatus comprising:

at least one heat exchanger configured to allow air to pass therethrough;

at least one axial fan provided behind the at least one heat exchanger in a direction of air flow, the axial fan having a circumferential ring;

a stationary baffle ring associated with the circumferential ring;

a fan shroud provided adjacent to the at least one heat exchanger; and at least one motion compensating element having a sealing function is provided between the stationary baffle ring and the fan shroud, wherein the stationary baffle ring is approximately C-shaped in cross-section and has an attachment section, and wherein the stationary baffle ring or an intake nozzle forms a 180° deflecting gap with a forward ring end of the circumferential ring, and wherein vanes or ribs that extend radially or substantially radially are provided on the stationary baffle ring or intake nozzle in a region of the deflecting gap.

17. The cooling apparatus according to claim 16, wherein the stationary baffle ring or the intake nozzle has an annular surface provided radially outside and an annular surface provided radially inside, and wherein the vanes project inward from the outer annular surface.

* * * * *